US005726001A

United States Patent [19]

Eichorst

[11] Patent Number: 5,726,001

[45] Date of Patent: Mar. 10, 1998

[54] COMPOSITE SUPPORT FOR IMAGING ELEMENTS COMPRISING AN ELECTRICALLY-CONDUCTIVE LAYER AND POLYURETHANE ADHESION PROMOTING LAYER ON AN ENERGETIC SURFACE-TREATED POLYMERIC FILM

[75] Inventor: Dennis John Eichorst, Fairport, N.Y.

[73] Assignee: Eastman Kodak Company, Rochester, N.Y.

[21] Appl. No.: 660,968

[22] Filed: Jun. 12, 1996

[51] Int. Cl.[6] ..... G03C 1/76; G03C 1/85

[52] U.S. Cl. ..... 430/523; 430/530; 430/531; 430/532; 430/501; 430/527

[58] Field of Search ..... 430/527, 523, 430/530, 531, 532, 501

[56] References Cited

U.S. PATENT DOCUMENTS

| | | | |
|---|---|---|---|
| 3,837,886 | 9/1974 | Tatsuta et al. | 430/510 |
| 3,849,166 | 11/1974 | Omichi et al. | 430/533 |
| 4,203,769 | 5/1980 | Gusestaux | 430/631 |
| 4,689,359 | 8/1987 | Ponticello et al. | 430/642 |
| 4,914,018 | 4/1990 | Besio et al. | 430/528 |
| 4,954,430 | 9/1990 | Ishigaki et al. | 430/534 |
| 5,310,640 | 5/1994 | Markin et al | 430/527 |
| 5,326,689 | 7/1994 | Murayama | 430/530 |
| 5,360,706 | 11/1994 | Anderson et al. | 430/529 |
| 5,360,707 | 11/1994 | Kato et al. | 430/538 |
| 5,368,995 | 11/1994 | Christian et al. | 430/530 |
| 5,425,980 | 6/1995 | Grace et al. | 430/532 |
| 5,427,835 | 6/1995 | Morrison et al. | 430/527 |
| 5,439,785 | 8/1995 | Boston et al. | 430/530 |
| 5,451,495 | 9/1995 | Falkner et al. | 430/531 |
| 5,457,013 | 10/1995 | Christian et al. | 430/140 |
| 5,484,694 | 1/1996 | Lelental et al. | 430/530 |
| 5,532,118 | 7/1996 | Bauer et al. | 430/533 |
| 5,609,969 | 3/1997 | Clatanoff et al. | 430/533 |

FOREIGN PATENT DOCUMENTS

| | | |
|---|---|---|
| 511764A1 | 11/1992 | European Pat. Off. . |
| 516275A1 | 12/1992 | European Pat. Off. . |
| 607905A1 | 7/1994 | European Pat. Off. . |
| 674218A1 | 9/1995 | European Pat. Off. . |
| 94/24607 | 10/1994 | WIPO . |

*Primary Examiner*—Mark F. Huff
*Attorney, Agent, or Firm*—Andrew J. Anderson

[57] ABSTRACT

In accordance with one embodiment of the invention a composite support for an imaging element is described, which composite support comprises a polymeric film having coated thereon an electrically conductive layer and an auxiliary layer coated over the electrically conductive layer, wherein the polymeric film comprises a surface which has been activated by energetic treatment, and wherein the composite support further comprises an adhesion promoting layer comprising an aqueous dispersible, aliphatic, anionic polyurethane binder having an ultimate elongation to break of at least 350 percent either between the polymeric film and the electrically conductive layer or between the electrically conductive layer and the auxiliary layer, and the electrically conductive layer or adhesion promoting layer is in contiguous contact with the activated surface of the polymeric film. In accordance with a further embodiment of the invention, an imaging element for use in an image-forming process is described, which element comprises such a composite support and at least one image-forming layer. The invention provides composite supports and imaging elements containing an electrically conductive antistatic layer having excellent adhesion to energetic surface-treated polymer film supports, and of auxiliary layers to the electrically conductive antistatic layer.

29 Claims, No Drawings

COMPOSITE SUPPORT FOR IMAGING ELEMENTS COMPRISING AN ELECTRICALLY-CONDUCTIVE LAYER AND POLYURETHANE ADHESION PROMOTING LAYER ON AN ENERGETIC SURFACE-TREATED POLYMERIC FILM

FIELD OF THE INVENTION

This invention relates in general to supports for imaging elements, such as photographic, electrostatophotographic and thermal imaging elements, and in particular to composite supports comprising a polymeric film and an electrically conductive antistatic layer, and imaging elements comprising such polymeric film, antistatic layer, and an image-forming layer. More particularly, this invention relates towards such composite supports and imaging elements wherein an electrically conductive layer is effectively adhered between the polymer film and an auxiliary layer through use of an adhesion promotion layer above or below the electrically conductive layer.

BACKGROUND OF THE INVENTION

Imaging elements are generally complicated systems comprising a support, adhesion or tie layers, image recording layers and auxiliary layers for improved performance such as electrically conductive antistatic layers, lubricant layers, abrasion resistant layers, curl-control layers, anti-halation layers, etc. The multiple layers required to achieve the desired performance results in a complicated coating process with severe requirements for adhesion to the support and between layers.

Adhesion of the auxiliary layers to a polymer film support has traditionally been achieved through the use of suitable adhesion or tie layers referred to as a subbing system. Such a subbing system generally involves chemical treatment of the polymer surface with an etch or "bite" agent to improve adhesion of a tie layer. Subsequently, a polymeric tie layer is coated which has good adhesion to the chemically treated surface and to which subsequently applied layers have good adhesion. Some useful compositions for this purpose include polymers containing vinylidene chloride such as vinylidene chloride/methyl acrylate/itaconic acid terpolymers or vinylidene chloride/acryionitrile/acrylic acid and the like; butadiene-based copolymers, glycidyl acrylate, or methacrylate containing copolymers, or maleic anhydride containing copolymers. These and other suitable compositions are described, for example, in U.S. Pat. Nos. 2,627,088; 2,698,240; 2,943,937; 3,143,421; 3,201,249; 3,271,178; 3,443,950; and 3,501,301. The polymeric subbing layer is in many instances overcoated with an additional subbing layer comprised of gelatin, typically referred to as a Gel sub. The first functional layer, which may frequently desirably be an antistatic layer for control of electrostatic charge, is generally applied after such surface-treatment and application of such subbing layers. This approach has several drawbacks, particularly with increasing demand for reduced environmental impact. Typical etch or bite agents include chlorinated or phenolic materials which may be corrosive and environmentally deleterious. The indicated etch or bite agents are also typically coated from solvents, in many cases chlorinated solvents which are intended to be reduced. The subbing systems generally require at least two separate coatings which result in manufacturing waste for each coating.

Problems associated with electrostatic charge in the manufacture and utilization of imaging elements are well-known. The accumulation of charge can result in dirt or dust attraction, producing physical defects. The discharge of accumulated charge during application or use of radiation sensitive layers (for example, photographic emulsions) can produce irregular fog patterns or static marks in the light sensitive layer(s). These static charge problems have become increasingly more severe due to increased photographic emulsion sensitivity, increased coating machine speeds, and increased post-coating drying efficiency. Transport charging results from the tendency of high dielectric materials to accumulate electrical charge when in relative motion to other materials. This results in static charging during coating and post-coating operations such as slitting and spooling. Static charge build-up may also occur during use of imaging elements, for example during winding of a roll of photographic film out of and back into a film cassette in an automatic camera. Static discharge during magnetic reading and writing can result in increased bit error rates. These problems can be exacerbated at low relative humidities. Similarly, high speed processing of imaging elements can result in static charge generation.

Due to the increasing demands for static charge control, electrically conductive "antistatic" layers incorporating a wide variety of ionically-conducting and electronically-conducting materials have been incorporated into photographic imaging, magnetic recording and other imaging elements. The requirements for antistatic layers in silver halide photographic films are especially demanding because of the stringent optical requirements associated with such films. As such antistatic layers are frequently the first functional auxiliary layer coated on a polymeric film support, much prior work has been directed towards providing good adhesion between such layers and the polymer film. Further, as additional auxiliary layers may be desirably coated over such antistatic layers, much work has also been directed towards providing good adhesion between the antistatic layer and the overcoated layers.

As an example of auxiliary layers which may be desirably coated over an antistatic layer, it is well known from various U.S. Pat. Nos., including 3,782,947; 4,279,945; 4,990,276; 5,217,804; 5,147,768;5,229,259; 5,255,031; and others that a radiation-sensitive silver halide photographic element may contain a transparent magnetic recording layer which can advantageously be employed to record information into and read information from the magnetic recording layer by techniques similar to those employed in the conventional magnetic recording art. The use of a magnetic recording layer for information exchange allows improved photographic print quality through input and output of information identifying the light-sensitive material, photographic conditions, printing conditions and other information. Additional auxiliary layers which may also be desirably present in imaging elements include abrasion resistant and other protective layers, abrasive-containing layers, adhesion promoting layers, curl control layers, transport control layers, lubricant layers and other magnetic layers for purposes such as improved web conveyance, optical properties, physical performance and durability.

The increasing need of additional layers for improved performance has resulted in numerous coating passes, greater complexity and more demanding adhesion requirements for imaging elements. Due to the desire to reduce the number of coating passes, reduce solvent emissions, and reduce or eliminate hazardous chemicals there has been a significant emphasis on identifying alternative methods of improving adhesion to polyester film supports. One such alternative method is to subject the support to some form of "energetic" treatment prior to coating. Examples of energetic treatments include glow-discharge treatment (GDT) or plasma treatment, corona-discharge treatment (CDT), ultraviolet radiation (UV) treatment, electron-beam treatment, and flame treatment. In some instances, these treatments produce adhesion superior to that of other approaches. In addition, such treatments can reduce the number of required coating passes, by replacing a subbing layer. Furthermore, such treatments have the potential to reduce solvent emissions and reduce or eliminate the use of hazardous chemicals associated with additional coatings or chemical etchants added to coating solutions.

Although it would be desirable to use an appropriate energetic treatment of a support to enable adhesion of a functional layer without the need for any subbing layers, energetic treatments have generally been used in combination with a subbing layer or some additional process treatments to provide adequate adhesion. Ponticello et al (U.S. Pat. No. 4,689,359) describe the use of CDT in combination with a single subbing layer made from an aqueous blend of gelatin and a mixture of polymerized vinyl monomers. Omichi et al (U.S. Pat. No. 3,849,166) describe the use of UV treatment in combination with a wet coating of hydrogen peroxide and then an additional subbing layer (either a hydrophilic resin solution or a gelatin dispersion containing a solvent or swelling agent). Kawamoto et al (EP 0 607 905 A2) describe in their examples the use of UV treatment in combination with heat and a single subbing layer made of gelatin, organic solvents, and p-chlorophenol (an etchant for polyester). Stroebel et al (EP 0 516 275 A1) describe the use of CDT in a nitrogen atmosphere in combination with heat and a single subbing layer made with polyalkyl acrylate or polyalkyl methacrylate and gelatin. Tatsuta and Ueno (U.S. Pat. No. 3,837,886) describe the use of GDT in combination with surface roughening of a polystyrene substrate; they find that GDT is ineffective without first roughening the polystyrene substrate. In these cases, the combination of surface-treatment and a single subbing layer replaces a two-layer subbing system or a single layer subbing system that has inferior adhesion in the absence of the energetic treatment. Energetic treatments are not found to be effective without subbing, etchants in the layer, or some other surface-treatment such as surface roughening. Ishigaki et al (U.S. Pat. No. 4,954,430), e.g., disclose glow-discharge treatment of polyester supports including polyethylene naphthalate for use in photographic imaging elements, claims being specific to the use of vinylidene chloride based subbing layers. Murayama (U.S. Pat. No. 5,326,689) teaches the use of glow-discharge treatment in the presence of water vapor to improve adhesion of gelatin based layers to polyester supports which have a glass transition temperature in the range of 90°–200° C. such as polyethylene naphthalate. Murayama found that glow-discharge was not especially effective for polyethylene terephthalate having a glass transition temperature of 69° C. Furthermore, if the partial pressure of water vapor was below 10% it was difficult to obtain sufficient adhesive properties. Finally, he teaches that glow-discharge treatment with water vapor in combination with heat treatment of a polyester support having a glass transition temperature in the given range is preferred.

Grace et al (U.S. Pat. No. 5,425,980) demonstrate that GDT provides better adhesion than obtained by the use of CDT with the single subbing layer disclosed by Ponticello. Furthermore, Grace et al demonstrate that GDT can be used to obtain excellent adhesion of a gelatin-based subbing layer (with no etchants, water vapor or heat treatment) or adhesion of a silver halide photographic emulsion layer directly to polyester support treated with GDT. Stroebel et al teach that superior adhesion of a specific coating to the desired substrate hinges on the correct combination of treatment of the polymer support and coating chemistry. Grace et al further teach that the details of the surface chemistry resulting from energetic surface-treatments is important for obtaining good adhesion to specific coatings. Thus, the surface-treatment produced by energetic treatment of the support must be appropriate for the chosen coating chemistry. The various forms of energetic surface-treatment are interchangeable only if they produce the same surface functionalities in similar amounts or if the coating to be applied is capable of significant chemical interaction with a broad range of surface functionalities that encompass those produced by the various forms of treatment.

Electrically conductive antistatic layers comprising conductive agents such as vanadium oxide gels dispersed in polymeric binders are well known, and such antistatic materials provide effective antistatic protection at advantageously low coverages. Such compositions, however, also present particularly severe adhesion and coating solution stability requirements, as indicated by the prior art directed towards such problems. U.S. Pat. No. 5,360,707, e.g., teaches the use of antistatic formulations of $V_2O_5$ in a polyesterionomer binder having excellent stability and adhesion to underlying and overlying layers. U.S. Pat. No. 5,427,835 discloses the use of sulfopolymers for binders with vanadium oxide antistatic compositions. These patents disclose the use of binders which impart improved stability to $V_2O_5$ and could potentially be applied to surface-treated supports. World Pat. No. 94/24607 indicates that the sulfopolyester based antistatic layer containing vanadium oxide has good adhesion to untreated supports. U.S. Pat. No. 5,427,835 teaches that the sulfopolyester based antistatic layer has excellent dry adhesion to flame treated polyethylene terephthalate. While antistatic formulations according to the above patents when overcoated with a transparent magnetic recording auxiliary layer generally are found to have excellent dry adhesion to surface-treated polyester supports, such formulations frequently exhibit poor wet adhesion characteristics. U.S. Pat. No. 5,439,785 describes the use of epoxy-silanes as adhesion promoters in conjunction with the sulfopolyester vanadium oxide layers for improved antistatic performance and adhesion.

Commonly assigned, concurently filed U.S. application Ser. No. 08/662,188, filed Jun. 12, 1996 the disclosure of which is incorporated by reference herein, describes the use of electrically conductive layers comprising electrically conductive agents dispersed in an aqueous dispersible, aliphatic, anionic polyurethane binder having an ultimate elongation to break of at least about 350 percent, wherein the electrically conductive layer is effectively adhered in contiguous contact with the activated surface of a polymeric film without use of an added subbing layer. Use of such binders generally enables both excellent wet and dry adhesion for electrically conductive layers comprising a variety of antistatic materials, including vanadium oxide gels, allowing for the tailoring of the electrically conductive antistatic layer to a variety of application needs typically without the use of additional subbing layers, etch agents, or other adhesion promoting species such as phenolics, epoxides, or chlorinated materials in the electrically conductive antistatic layer.

Due to the exceptional adhesion requirements of electrically conductive layers containing some electrically conductive agents, even antistatic layers comprising a polyurethane binder as described in U.S. application Ser. No. 08/662,188, filed Jun. 12, 1996 may exhibit poor adhesion when directly coated on an energetic surface-treated support and subsequently overcoated with an auxiliary layer such as a transparent magnetic recording layer, particularly antistatic layers comprising amorphous gel antistatic agents such as vanadium oxides at polymeric binder/vanadium oxide ratios of less than about 12/1, and especially less than 4/1, and most particularly such antistatic layers overcoated with a cellulosic-based transparent magnetic recording layer. Accordingly, it may be required to coat such compositions at relatively high binder to vanadium oxide ratios.

High binder to vanadium oxide gel ratios, however, result in significantly higher resistivity for a given layer coverage, and thus require higher layer coverages to obtain adequate conductivity for effective antistatic protection. Higher binder to vanadium oxide gel ratios also generally results in poor coating solution stability for many binders, especially polyurethane binders.

Additionally, some polymeric binders previously proposed for use in vanadium oxide gel or other antistatic agent containing antistatic layers which have advantageous coating solution stability do not adhere well directly to surface-treated supports even at relatively high binder/vanadium oxide gel ratios.

SUMMARY OF THE INVENTION

It would be desirable to provide composite supports and imaging elements comprising electrically conductive antistatic layers which adhere well to surface-treated polyester films. It would be further desirable to provide such electrically conductive layers coated from stable coating solutions.

The present invention meets these and other objectives by providing an adhesion promoting layer comprising an aqueous dispersible polyurethane, which layer provides excellent adhesion of antistatic layers comprising a conductive agent and a variety of polymeric binders and auxiliary overcoat layers to supports treated with a variety of energetic surface-treatment conditions.

In accordance with one embodiment of the invention a composite support for an imaging element is described, which composite support comprises a polymeric film having coated thereon an electrically conductive layer and an auxiliary layer coated over the electrically conductive layer, wherein the polymeric film comprises a surface which has been activated by energetic treatment, and wherein the composite support further comprises an adhesion promoting layer comprising an aqueous dispersible, aliphatic, anionic polyurethane binder having an ultimate elongation to break of at least about about 350 percent either between the polymeric film and the electrically conductive layer or between the electrically conductive layer and the auxiliary layer, and the electrically conductive layer or adhesion promoting layer is in contiguous contact with the activated surface of the polymeric film.

In accordance with a further embodiment of the invention, an imaging element for use in an image-forming process is described, which element comprises a support, at least one image-forming layer, an electrically conductive layer, and an auxiliary layer over the electrically conductive layer, wherein the support comprises a surface which has been activated by energetic treatment, the electrically conductive layer comprises an electrically conductive agent dispersed in a polymeric binder, and wherein the element further comprises an adhesion promoting layer comprising an aqueous dispersible, aliphatic, anionic polyurethane binder having an ultimate elongation to break of at least about 350 percent either between the support and the electrically conductive layer or between the electrically conductive layer and the auxiliary layer, and the electrically conductive layer or adhesion promoting layer is in contiguous contact with the activated surface of the support.

The invention provides composite supports and imaging elements containing an electrically conductive antistatic layer having excellent adhesion to energetic surface-treated polymer film supports, and of auxiliary layers to the electrically conductive antistatic layer.

DETAILED DESCRIPTION OF THE INVENTION

The composite supports of this invention can be used for many different types of imaging elements. While the invention is applicable to a variety of imaging elements such as, for example, photographic, electrostatophotographic, photothermographic, migration, electrothermographic, dielectric recording and thermal-dye-transfer imaging elements, the invention is primarily applicable to photographic elements, particularly silver halide photographic elements. Accordingly, for the purpose of describing this invention and for simplicity of expression, photographic elements will be primarily referred to throughout this specification; however, it is to be understood that the invention also applies to other forms of imaging elements.

Photographic elements which can be provided with an antistatic layer in accordance with the invention can differ widely in structure and composition. For example, they can vary greatly in the type of support, the number and composition of image-forming layers, and the kinds of auxiliary layers that are included in the elements. In particular, the photographic elements can be still films, motion picture films, x-ray films, graphic arts films, prints, or microfiche. They can be black-and-white elements or color elements. They may be adapted for use in a negative-positive process or for use in a reversal process.

Polymer film supports which are useful for the present invention include polyester supports such as, polyethylene terephthalate, poly-1,4-cyclohexanedimethylene terephthalate, polyethylene 1,2-diphenoxyethane-4,4'-dicarboxylate, polybutylene terephthalate, and polyethylene naphthalate and the like; and blends or laminates thereof. Particularly preferred embodiments are polyethylene terephthalate and polyethylene naphthalate. The supports can either be colorless or colored by the addition of a dye or pigment. It should also be noted that the invention applies to suitable polyester supports with treatments and/or coatings applied to the side opposite that which is to be coated with the electrically conductive layer or adhesion promoting layer of the present invention.

Because of the unexpected latitude in treatment afforded by the invention, a wide range of surface chemistries are useful with the adhesion promoting layer and disclosed electrically conductive antistatic layers. Therefore, useful film supports can be surface-treated by various energetic processes including, but not limited to corona-discharge treatment, glow-discharge or plasma treatment, ultraviolet radiation, flame treatment and electron beam treatment. Preferred surface-treatment methods are corona-discharge treatment, glow-discharge treatment and exposure to ultraviolet radiation.

Corona-discharge may be carried out in air or a controlled atmosphere containing oxygen or nitrogen using commercially available corona-discharge treatment equipment. Glow-discharge treatment may involve a variety of gases such as oxygen, nitrogen, helium, argon, carbon dioxide, ammonia, water vapor, or admixtures thereof. Most preferred are oxygen, nitrogen or admixtures thereof. Glow-discharge treatment may be achieved using reduced pressures or atmospheric pressures. Treatment doses may range from approximately 0.01 to 10 J/cm$^2$ and more preferably from 0.05 to 5 J/cm$^2$.

The ranges of treatment doses, gas compositions and pressures used in the examples below are known to produce a wide range of surface chemistries on treated supports. Specifically, it is shown in U.S. Pat. No. 5,425,980 that nitrogen glow-discharge treatments produce a variety of nitrogen-containing species such as imines, primary amines, and secondary amines on treated polyester surfaces. In addition, the nitrogen treatments can induce rearrangement of the ester functionality. The distribution and amount of nitrogen-containing species and degree of ester rearrangement depend on treatment conditions. In contrast, oxygen glow-discharge treatments do not incorporate nitrogen but incorporate oxygen and induce formation of hydroxyl, ether, epoxy, carbonyl, and carboxyl species on the treated polyester surface. The distribution and amount of these oxygen containing species depend on treatment conditions. Furthermore, corona-discharge treatments incorporate significantly less nitrogen than nitrogen GDT and induce significantly less rearrangement of ester groups than either oxygen or nitrogen GDT. Further chemical differences between CDT and plasma-treated supports (i.e., GDT) are revealed by contact angle measurements as a function of pH of the contacting liquid.

Any of a variety of discharge geometries may be used, including treatment of a free span of web or the web may alternatively be placed against a holder or drum. Provision may also be made for treating both sides of the web, either for application of this invention to either side, or for situations where a different (or identical) treatment is required on the opposite side for some other function.

The adhesion promoting layer of the invention comprises an aqueous dispersible polyurethane binder which is aliphatic in nature, has an anionic particle charge and is characterized by an ultimate elongation prior to breaking of at least about 350 percent. Several suitable aliphatic, anionic polyurethanes for use in accordance with the invention are commercially available, for example, from Witco Chemical Co., Greenwich, Conn., including Witcobond W-290H (ultimate elongation 600%), W-293 (725%), W-506 (550%), W-236 (450%), and W-234 (350%).

The adhesion promoting layer preferably is coated at a polyurethane coverage of from about 0.01 to 1 g/m$^2$, more preferably 0.015 to 0.2 g/m$^2$. As demonstrated in the Examples below, it is a surprising finding that such adhesion promoting layers, even at coverages as low as about 0.01 g/m$^2$, coated either above or below the antistatic layer significantly improves both dry and wet adhesion performance for antistatic layers in accordance with the invention coated on an energetic surface-treated support which are overcoated with an auxiliary layer such as a transparent magnetic layer.

The electrically conductive antistatic layer of the elements according to the invention preferably comprises a polymeric binder which may have a variety of antistatic or other functional materials dispersed within it. The functional materials may include ionically conducting materials, electronically conductive particles, electronically conductive polymers, magnetic particles, abrasive particles, matte particles, dispersants, surface active agents, dyes, lubricants, haze reducing agents, adhesion promoting agents, hardeners, etc. A preferred embodiment of the invention includes the use of electronically conductive materials to yield an electrically conductive antistatic layer.

Electronically conductive particles which may be used in the electrically conductive antistatic layer of the present invention include, e.g., conductive crystalline inorganic oxides, conductive metal antimonates, and conductive inorganic non-oxides. Crystalline inorganic oxides may be chosen from ZnO, $TiO_2$, $SnO_2$, $Al_2O_3$, $In_2O_3$, $SiO_2$,MgO, BaO, $MoO_3$, $WO_3$, and $V_2O_5$ or composite oxides thereof, as described in, e.g., U.S. Pat. Nos. 4,275,103; 4,394,441; 4,416,963; 4,418,141; 4,431,764; 4,495,276; 4,571,361; 4,999,276 and 5,122,445. The conductive crystalline inorganic oxides may contain a "dopant" in the range from 0.01 to 30 mole percent, preferred dopants being Al or In for ZnO; Nb or Ta for $TiO_2$; and Sb, Nb or halogens (F, Cl, Br and I) for $SnO_2$. Alternatively, the conductivity can be enhanced by formation of oxygen defects by methods well known in the art. The use of antimony-doped tin oxide at an antimony doping level of at least 8 atom percent and having an X-ray crystallite size less than 100 Å and an average equivalent spherical diameter less than 15 nm but no less than the X-ray crystallite size as taught in U.S. Pat. No. 5,484,694 is specifically contemplated.

Conductive metal antimonates suitable for use in accordance with the invention include those as disclosed in, e.g., U.S. Pat. Nos. 5,368,995 and 5,457,013. Preferred conductive metal antimonates have a rutile or rutile-related crystallographic structures and may be represented as $M^{+2}Sb^{+5}{}_2O_6$ (where $M^{+2}$=$Zn^{+2}$, $Ni^{+2}$, $Mg^{+2}$, $Fe^{+2}$, $Cu^{+2}$, $Mn^{+2}$, $Co^{+2}$) or $M^{+3}Sb^{+5}O_4$ (where $M^{+3}$=$In^{+3}$, $Al^{+3}$, $Sc^{+3}$, $Cr^{+3}$, $Fe^{+3}$). Several colloidal conductive metal antimonate dispersions are commercially available from Nissan Chemical Company in the form of aqueous or organic dispersions. Alternatively, U.S. Pat. Nos. 4,169,104 and 4,110,247 teach a method for preparing $M^{+2}Sb^{+5}{}_2O_6$ by treating an aqueous solution of potassium antimonate with an aqueous solution of an appropriate metal salt (e.g., chloride, nitrate, sulfate, etc.) to form a gelatinous precipitate of the corresponding insoluble hydrate which may be converted to a conductive metal antimonate by suitable treatment.

Conductive inorganic non-oxides suitable for use as conductive particles in the present invention include: TiN, $TiB_2$, TiC, $NbB_2$, WC, $LaB_6$, $ZrB_2$, MoB, and the like, as described, e.g., in Japanese Kokai No. 4/55492, published Feb. 24, 1992.

The conductive particles present in the electrically conductive antistatic layer are not specifically limited in particle size or shape. The particle shape may range from roughly spherical or equiaxed particles to high aspect ratio particles such as fibers, whiskers or ribbons. Additionally, the conductive materials described above may be coated on a variety of other particles, also not particularly limited in shape or composition. For example the conductive inorganic material may be coated on non-conductive $SiO_2$, $Al_2O_3$ or $TiO_2$ particles, whiskers or fibers.

The invention is particularly applicable where the conductive agent comprises a conductive "amorphous" gel such as vanadium oxide gel comprised of vanadium oxide ribbons or fibers, as layers comprising such conductive agents have been found to present particularly demanding adhesion requirements. Such vanadium oxide gels may be prepared by any variety of methods, including but not specifically limited to melt quenching as described in U.S. Pat. No. 4,203,769, ion exchange as described in DE 4,125,758, or hydrolysis of a vanadium oxoalkoxide as claimed in WO 93/24584. The vanadium oxide gel is preferably doped with silver to enhance conductivity. Other methods of preparing vanadium oxide gels which are well known in the literature include reaction of vanadium or vanadium pentoxide with hydrogen peroxide and hydrolysis of $VO_2OAc$ or vanadium oxychloride.

The conductive agent may also be a carbon filament as disclosed by Papadopoulos in copending, commonly assigned U.S. Ser. No. 08/588,180 filed Jan. 18, 1996, the disclosure of which is incorporated by reference herein. Recently there have been several commercial sources of carbon filaments or fibers including Applied Sciences, inc., Cedarville, Ohio, under license from GM. Alternatively, carbon filaments suitable for antistatic applications may be prepared by a variety of methods including pyrolysis of polymeric fibers such as polyacrylonitrile, and vapor phase growth or seeded vapor phase growth. The preferred method is vapor phase growth using metal catalyst seed particles which initiate fiber growth and act as a diffusion transport medium. In this process the fiber diameter can be controlled by the size of the catalyst particle.

Electrically conductive polymers as exemplified by polyanilines and polythiophenes may also be used as conductive agents for the electrically conductive antistatic layer of the imaging elements in accordance with the invention.

The polymeric binder of the electrically conductive layer is preferably an aqueous dispersible polymeric binder. Such binders include polyesterionomers, sulfopolymers, polyvinyl chloride resins, vinylidene chloride based latexes, aqueous dispersible polyurethanes, and cellulose derivatives. Additional useful binders include soluble polyamides, styrene/maleic anhydride copolymers and polystyrene sulfonic acid.

Polyesterionomer binders for the electrically conductive layer may be, e.g., anionic polyesterionomers containing an anionic moiety such as carboxylic acid groups, metal salts of carboxylic acid groups, sulfonic acid groups or metal salts of sulfonic acid groups as taught in, e.g., U.S. Pat. No. 5,360,706. The metal salts may be sodium, lithium or potassium salts. Sulfopolymers include sulfopolyesters, ethylenically-unstaurated sulfopolymers, sufopolyurethanes, sulfopolyurethane/polyureas, sulfopolyester polyols, and sulfopolyols as taught in, e.g., U.S. Pat. No. 5,427,835. Preferred sulfopolymers are poly(sodium styrene sulfonate) available from Polyscience, Inc., Warrington, Pa. and alkylene oxide-co-sulfonate containing polyesters (AQ resins available from Eastman Chemicals). Preferred vinylidene chloride based polymers include terpolymers of vinylidene chloride/methyl acrylate/itaconic acid and vinylidene chloride/acrylonitrile/acrylic acid. Preferred aqueous dispersible polyurethanes include aqueous dispersible aliphatic polyurethanes, particularly aqueous dispersible anionic aliphatic polyurethanes such as those described with respect to the adhesion promoting layer as described above. Also preferable are polyurethanes which include no sulfonated groups and which are stable in an acidic medium, such as Bayer's Polyurethane-dispersion V™, a linear polyurethane comprising mixed hexamethylene diisocyanate ester recurring units. Preferred cellulose derivatives include cellulose nitrate, cellulose acetate phthalate, hydroxyethyl cellulose, hydroxypropyl cellulose, and the like.

Polyvinylidene chloride based vanadium oxide antistatic layers are preferred for their coating solution stability, but are challenged for adhesion to energetic surface-treated supports. It was especially surprising that the adhesion promoting layer of the invention is effective when coated above such antistatic layers as well as below as demonstrated in the Examples below.

Polyurethanes in general, and especially polyurethanes which are aliphatic in nature, have an anionic particle charge and are characterized by an ultimate elongation prior to breaking of at least 350 percent as described above with respect to the adhesion promoting layer binders, are preferred for use as the antistatic layer binder. As analysis of adhesion failure for antistatic layers comprising relatively low polyurethane binder/vanadium oxide gel ratios coated directly on an energetic surface-treated support and overcoated with a transparent magnetic layer comprising a cellulosic binder indicates failure occurs due to poor adhesion between the antistatic layer and the magnetic layer, it was especially surprising that the adhesion promoting layer of the invention is effective when coated below such antistatic layers as well as above as demonstrated in the Examples below.

Generally, increased loading of conductive materials results in reduced adhesion, although in certain instances adhesion may be enhanced by the presence of the conductive material. Therefore, the desired ratio of conductive material to binder and the total coverage of the electrically conductive antistatic layer depend on the required conductivity for charge control and the nature of the conductive material.

For conductive particles (e.g., conductive metal oxides, conductive metal antimonates, or conductive inorganic non-oxides) which are roughly equiaxed or of a low aspect ratio (i.e., less than approximately 3) it is preferred that the conductive particles be present in the electrically conductive layer in an amount from approximately 10 to 80 volume percent. The total coverage of the electrically conductive layer containing conductive oxide fine particles or metal antimonates may preferably range from approximately 0.10 to 1.0 $g/m^2$.

For a conductive vanadium oxide gel it is preferred that the ratio of binder/vanadium oxide gel be in the weight ratio of ½ to 300/1 and more preferably from approximately 1/1 up to 200/1. For coating solution stability, ratios of about 4/1 or less are preferred. Use of a separate adhesion promoting layer either above or below the electrically conductive layer in accordance with the invention allows lower binder/conductive agent ratios to be used in the electrically conductive layer coating solution, which are generally more stable and effective at lower coating coverages, while providing effective adhesion to the support and overcoated auxiliary layers. The required coverage of the electrically conductive antistatic layer depends on an appropriate thickness to achieve the desired resistivity level which is determined in a large part on the polymeric binder to antistatic ratio. Preferred coverages range from approximately 0.005 to 1.50 $g/m^2$ with the higher coverages preferred at higher binder/vanadium oxide ratios.

In addition to antistatic agents, the electrically conductive antistatic layer may include addenda such as dispersants, surface active agents, plasticizers, solvents, co-binders, matte particles, magnetic particles, filler particles, soluble dyes, solid particle dyes, haze reducing agents, adhesion promoting agents, hardeners, etc. For altering the coating and drying characteristics it is a common practice in the art to use surface active agents (coating aids) or to include a water miscible solvent in an aqueous dispersion. Suitable solvents include ketones such as acetone or methyl ethyl ketone, and alcohols such as ethanol, methanol, isopropanol, n-propanol, and butanol.

The antistatic layer coating formulation may be prepared as a single dispersion comprising conductive material, binder and optional coating aids or other addenda or alternatively may be prepared as multiple dispersions which are brought together and mixed immediately prior to coating in a technique known as mixed melt formation. This latter process reduces the potential need of surface active agents for improved dispersion stability (dispersants) and avoids potential solution incompatibility problems between the binder and conductive agent or addenda. The mixed melt process is particularly useful for the preparation of electrically conductive antistatic layers containing vanadium oxide gel.

The electrically conductive antistatic layer of the present invention may optionally be overcoated with a wide variety of additional functional or auxiliary layers such as abrasion resistant layers, curl control layers, transport control layers, lubricant layers, image recording layers, additional adhesion promoting layers, layers to control water or solvent permeability, and transparent magnetic recording layers. In a preferred embodiment of the invention, the antistatic layer is overcoated with at least a transparent magnetic recording layer and an optional lubricant layer. A permeability control layer may also be preferably coated between the antistatic layer and transparent magnetic recording layer. Magnetic layers suitable for use in the composite supports and imaging elements in accordance with the invention include those as described, e.g., in *Research Disclosure*, November 1992, Item 34390. *Research Disclosure* is published by Kenneth Mason Publications, Ltd., Dudley House, 12 North Street, Emsworth, Hampshire P010 7DQ, ENGLAND.

Suitable polymeric binders for auxiliary layers including transparent magnetic recording layers) which may be coated over the electrically conductive antistatic layer include: gelatin; cellulose compounds such as cellulose nitrate, cellulose acetate, cellulose diacetate, cellulose triacetate, carboxymethyl cellulose, hydroxyethyl cellulose, cellulose acetate butyrate, cellulose acetate propionate, cellulose acetate phthalate and the like; vinyl chloride or vinylidene chloride-based copolymers such as, vinyl chloride-vinyl acetate copolymers, vinyl chloride-vinyl acetate-vinyl alcohol copolymers, vinyl chloride-vinyl acetate-maleic acid copolymers, vinyl chloride-vinylidene chloride copolymers, vinyl chloride-acrylonitrile copolymers, acrylic ester-vinylidene chloride copolymers, methacrylic ester-vinylidene chloride copolymers, vinylidene chloride-acrylonitrile copolymers, acrylic ester-acrylonitrile copolymers, methacrylic ester-styrene copolymers, thermoplastic polyurethane resins, thermosetting polyurethane resins, phenoxy resins, phenolic resins, epoxy resins, polycarbonate or polyester resins, urea resins, melamine resins, alkyl resins, urea-formaldehyde resins, and the like; polyvinyl fluoride, butadiene-acrylonitrile copolymers, acrylonitrile-butadiene-acrylic acid copolymers, acrylonitrile-butadiene-methacrylic acid copolymers, polyvinyl alcohol, polyvinyl butyral, polyvinyl acetal, styrene-butadiene copolymers, acrylic acid copolymers, polyacrylamide, their derivatives and partially hydrolyzed products; and other synthetic resins. Other suitable binders include aqueous emulsions of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, vinyl and vinylidene halides, and olefins and aqueous dispersions of polyurethanes or polyesterionomers. Preferred binders are polyurethanes, vinyl chloride based copolymers, acrylics or acrylamides and cellulose esters, particularly cellulose diacetate and cellulose triacetate.

Permeability control layers are useful for protecting those antistatic agents for which conductivity may degrade upon exposure to photographic processing solutions such as vanadium oxide gels. The additional auxiliary layers may be present in the imaging element either above or below the image recording element or on the side of the support opposite the recording layer. Preferred permeability control layers comprise relatively hydrophobic polymers selected from the above list of binders, including cellulose esters such as cellulose diacetate and cellulose triacetate, polyesters, and poly(alkyl (meth)acrylates).

Transparent magnetic recording layers used in composite supports and imaging elements in accordance with preferred embodiments of the invention are comprised of magnetic particles dispersed in a film-forming binder. The layer may contain optional additional components for improved manufacturing or performance such as crosslinking agents or hardeners, catalysts, coating aids, dispersants, surfactants, including fluorinated surfactants, charge control agents, lubricants, abrasive particles, filler particles and the like. The magnetic particles of the present invention can comprise ferromagnetic or ferrimagnetic oxides, complex oxides including other metals, metallic alloy particles with protective coatings, ferrites, hexaferrites, etc. and can exhibit a variety of particulate shapes, sizes, and aspect ratios. Ferromagnetic oxides useful for transparent magnetic coatings include $\gamma$-$Fe_2O_3$, $Fe_3O_4$, and $CrO_2$. The magnetic particles optionally can be in solid solution with other metals and/or contain a variety of dopants and can be overcoated with a shell of particulate or polymeric materials. Preferred additional metals as dopants, solid solution components or overcoats are Co and Zn for iron oxides; and Li, Na, Sn, Pb, Fe, Co, Ni, and Zn for chromium dioxide. Surface-treatments of the magnetic particle can be used to aid in chemical stability or to improve dispersability as is commonly practiced in conventional magnetic recording. Additionally, magnetic oxide particles may contain a thicker layer of a lower refractive index oxide or other material having a low optical scattering cross-section as taught in U.S. Pat. Nos. 5,217,804 and 5,252,441. Cobalt surface-treated $\gamma$-iron oxide is the preferred magnetic particle.

The image-forming layer for imaging elements comprising an electrically conductive layer in accordance with the invention may be present on the same side of the support as the electrically conductive layer or on the opposite side. In preferred embodiments of the invention, the imaging element comprises a photographic element, and the image forming layer comprises a silver halide emulsion layer on the opposite side of the support relative to the electrically conductive layer.

Photographic elements in accordance with the preferred embodiment of the invention can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, antihalation layers, overcoat layers, subbing layers, and the like.

Photographic elements in accordance with one embodiment of the invention are preferably used in conjunction with an applied magnetic layer as described in *Research Disclosure*, November 1992, Item 34390. It is also specifically contemplated to use composite supports according to the invention in combination with technology useful in small format film as described in *Research Disclosure*, June 1994, Item 36230. *Research Disclosure* is published by Kenneth Mason Publications, Ltd., Dudley House, 12 North Street, Emsworth, Hampshire P010 7DQ, ENGLAND.

In the following discussion of suitable materials for use in the photographic emulsions and elements that can be used in conjunction with the composite supports of the invention, reference will be made to *Research Disclosure*, September 1994, item 36544, available as described above, which will be identified hereafter by the term "*Research Disclosure*." The Sections hereafter referred to are Sections of the *Research Disclosure*, Item 36544.

The silver halide emulsions employed in the image-forming layers of photographic elements can be either negative-working or positive-working. Suitable emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing can be found in Sections XI–XX.

In addition to silver halide emulsion image-forming layers, the image-forming layer of imaging elements in accordance with the invention may comprise, e.g., any of the other image forming layers described in Christian et al. U.S. Pat. No. 5,457,013, the disclosure of which is incorporated by reference herein.

The following examples demonstrate the superior performance and robustness of the present invention.

EXAMPLE 1

Antistatic formulations were prepared using a conductive vanadium oxide sol dispersed in binder W-236 (Witco Corp. Greenwich, Conn.), an aqueous dispersible, aliphatic, anionic polyurethane binder having an ultimate elongation to break of 450 percent, and a coating aid of Triton X-100 surfactant (Rohm and Haas). The vanadium oxide sol was a silver doped vanadium oxide prepared by the melt-quenching technique as taught by Guestaux in U.S. Pat. No. 4,203,769. Coating dispersions were formulated for a W-236/vanadium oxide/surfactant weight ratio of 1/1/1.

The coating formulation was applied, using a coating hopper, to a moving web of nominally 0.1 millimeter thick polyethylene naphthalate to form an electrically-conductive antistatic layer at a total of 0.01 g/m$^2$ dry weight. The polyethylene naphthalate web was surface-treated by glow-discharge treatment using an oxygen atmosphere prior to coating the electrically conductive antistatic layer. The surface-treatment was carried out at a power of 330 W and residence time of 0.6 seconds corresponding to a dose of 0.4 J/cm$^2$. Pressure was 100 mTorr.

The electrically conductive layer was overcoated with a transparent magnetic layer as described in Research Disclosure, item 34390, November, 1991. The transparent magnetic layer comprised a dispersion of cobalt-modified γ-iron oxide particles in a polymeric binder comprising a mixture of cellulose diacetate and cellulose triacetate. Total dry coverage for the magnetic layer was nominally about 1.5 g/m$^2$.

Additional composite supports were prepared in a similar manner, however, a separate polyurethane adhesion promoting layer of 0.01, 0.04, 0.1, or 0.2 g/m$^2$ was coated either above or below the antistatic layer (i.e., either between the magnetic and antistatic layers or between the support and antistatic layer).

Antistatic performance was evaluated by measuring the internal resistivities of the overcoated electrically conductive antistatic layers by the salt bridge method (see, for example, "Resistivity Measurements on Buried Conductive Layer" by R. A. Elder, pages 251–254, 1990 EOS/ESD Symposium Proceedings). This measurement is referred to as a wet electrode resistivity (WER) measurement. Results are reported as log ohm/sq with lower numbers indicating less resistivity and better antistatic performance. For many applications a WER value of 10 log ohm/sq or less is desired.

Dry adhesion of the samples was evaluated by scribing a small crosshatched region into the coating with a razor blade, placing a piece of high tack adhesive tape over the scribed area, and then quickly stripping the tape from the surface. The amount of material removed from the scribed region is a measure of dry adhesion. No removal is rated as excellent, less than 1 percent removal is good, between 1 and 10 percent is fair, 10 to 50 percent is poor, and greater than or equal to 50 percent is very poor.

Wet adhesion was evaluated in a manner which simulates photographic processing. A one millimeter wide line was scribed into the overcoat layer. The sample was then placed into a Flexicolor developer solution at 38° C. for 3 minutes and 15 seconds and removed. The sample was then placed in Flexicolor developer and a weighted rubber pad (approximately 3.5 cm dia.) was rubbed vigorously across the sample in a direction perpendicular to the line. The applied weight was 900 g. The amount of additional material removed is a relative measure of wet adhesion. The same rating scale was used as for dry adhesion. The results are reported in Table 1 below.

TABLE 1

| Antistat layer W-236/$V_2O_5$(1/1) at 0.01 g/m$^2$ | | | | | | |
|---|---|---|---|---|---|---|
| | pad above antistat | | | pad below antistat | | |
| Pad g/m$^2$ | WER | Dry adh. | Wet adh. | WER | Dry adh. | Wet adh. |
| none | 7.7 | v. poor | v. poor | 7.7 | v. poor | v. poor |
| 0.01 | 8.2 | fair | exc. | 7.7 | fair | exc. |
| 0.04 | 8.3 | exc. | exc. | 7.9 | exc. | exc. |

TABLE 1-continued

| Antistat layer W-236/$V_2O_5$(1/1) at 0.01 g/m$^2$ | | | | | | |
|---|---|---|---|---|---|---|
| | pad above antistat | | | pad below antistat | | |
| Pad g/m$^2$ | WER | Dry adh. | Wet adh. | WER | Dry adh. | Wet adh. |
| 0.1 | 7.8 | exc. | exc. | 8.0 | exc. | exc. |
| 0.2 | 7.9 | exc. | exc. | 7.9 | exc. | exc. |

The sample without an adhesion promoting layer according to the invention was found to have extremely poor adhesion, complete removal for dry testing, and a load of only 100 g created as much damage as a 1500 g load creates for standard photographic film. After dry adhesion, the failure site was tested with a dye, which indicated the polyurethane/antistatic layer remained, indicating adhesion failure occured between the antistatic and magnetic layers.

The use of a polyurethane adhesion promoting layer, even at a coverage as low as 0.01 g/m$^2$, gave a significant improvement in adhesion. Surprisingly, the improvement in adhesion did not appear to depend on the placement of the polyurethane layer. The use of the adhesion promoting layer also did not significantly change the conductivity performance of the antistatic layer.

EXAMPLE 2

Example 1 was essentially repeated, except the antistatic layer was formulated at a 4/1/1 weight ratio of binder/$V_2O_5$/surfactant, and was coated at 0.04 g/m$^2$ total dry coverage. The results are reported in Table 2 below.

TABLE 2

| Antistat layer W-236/$V_2O_5$(4/1) at 0.04 g/m$^2$ | | | | | | |
|---|---|---|---|---|---|---|
| | pad above antistat | | | pad below antistat | | |
| Pad g/m$^2$ | WER | Dry adh. | Wet adh. | WER | Dry adh. | Wet adh. |
| none | 6.8 | fair | poor | 6.8 | fair | poor |
| 0.01 | 6.8 | exc. | exc. | 6.8 | good | exc. |
| 0.04 | 6.9 | exc. | exc. | 6.9 | exc. | exc. |
| 0.1 | 7.0 | exc. | exc. | 6.8 | exc. | exc. |
| 0.2 | 6.9 | exc. | exc. | 6.8 | exc. | exc. |

As in Example 1, the use of a polyurethane adhesion promoting layer either above or below the antistatic layer, even at a coverage as low as 0.01 g/m$^2$, gave a significant improvement in adhesion. Again, the use of the adhesion promoting layer did not significantly change the conductivity performance of the antistatic layer.

EXAMPLE 3

Example 1 was essentially repeated, except a terpolymer latex of vinylidene chloride/acrylonitrile/acrylic acid was used as the binder for the antistatic layer rather than a polyurethane binder. The results are reported in Table 3 below.

TABLE 3

| | pad above antistat | | | pad below antistat | | |
|---|---|---|---|---|---|---|
| Pad g/m$^2$ | WER | Dry adh. | Wet adh. | WER | Dry adh. | Wet adh. |
| none | 6.6 | v. poor | fair | 6.6 | v. poor | fair |
| 0.01 | 6.8 | v. poor | fair | 7.7 | fair | good |
| 0.04 | 7.0 | exc. | exc. | 7.2 | good | exc. |
| 0.1 | 7.0 | exc. | exc. | 7.2 | exc. | exc. |
| 0.2 | 7.2 | exc. | exc. | 7.2 | exc. | exc. |

As with Examples 1 and 2, the above results demonstrate that the polyurethane adhesion promoting layer in accordance with the invention is similarly useful for improving the adhesion of antistatic layers comprising vinylidene chloride based vanadium oxide gel layers on energetic surface-treated supports. Again, the use of the adhesion promoting layer either above or below the antistatic layer was unexpectedly found to greatly improve adhesion.

The above examples demonstrated the surprising results of the present invention. In accordance with such results, the invention allows for considerable flexibility in the coating sequence of layers for imaging elements. Simultaneous coating of several layers by methods such as slide coating or dual X-hopper coating or curtain coating place stringent requirements on the thickness of each layer. Since excellent adhesion is obtained for a variety of polyurethane thicknesses coating either above or below the antistatic layer, considerable flexibility is offered for choosing a preferred coating format. It is most advantageous to simultaneously coat at least two of the layers. As demonstrated in commonly assigned, concurently filed U.S. application No. 08/662,188 incorporated by reference above, polyurethane binder layers in accordance with the invention may be applied effectively to a variety of polyester supports which are modified by a variety of energetic surface-treatment methods. The combination of polyurethane adhesion promoting layer and electrically conductive antistatic layer of the present invention also provides adhesion for a variety of other polymers which may be coated over the electrically conductive antistatic layer and used as the binder for auxiliary functional layers. The present invention achieves both excellent wet and dry adhesion without the drawback of increased solvent emissions. Furthermore, adhesion is achieved without the use of etch agents or other adhesion promoting species such as phenolics, epoxides, or chlorinated materials in the electrically conductive antistatic layer. The simple coating formulation, flexibility and robustness allow the electrically conductive antistatic layer to be used in a wide variety of imaging element packages.

I claim:

1. A composite support for an imaging element, comprising a polymeric film having coated thereon an electrically conductive layer and an auxiliary layer coated over the electrically conductive layer, wherein the polymeric film comprises a surface which has been activated by energetic treatment, and wherein the composite support further comprises an adhesion promoting layer comprising an aqueous dispersible, aliphatic, anionic polyurethane binder having an ultimate elongation to break of at least 350 percent either between the polymeric film and the electrically conductive layer or between the electrically conductive layer and the auxiliary layer, and the electrically conductive layer or adhesion promoting layer is in contiguous contact with the activated surface of the polymeric film.

2. A composite support according to claim 1 wherein the electrically conductive layer comprises an electrically conductive agent dispersed in a polymeric binder.

3. A composite support according to claim 2, wherein the polymeric binder of the electrically conductive layer comprises an aqueous dispersible polyurethane binder.

4. A composite support according to claim 3, wherein the binder of the electrically conductive layer comprises an aliphatic, anionic polyurethane having an ultimate elongation to break of at least 350 percent.

5. A composite support according to claim 3, wherein the electrically conductive agent comprises vanadium oxide gel.

6. A composite support according to claim 5, wherein the electrically conductive layer polymeric binder and vanadium oxide gel are present in the electrically conductive layer at a weight ratio in the range of from about 1:2 to 12:1.

7. A composite support according to claim 2, wherein the electrically conductive agent comprises vanadium oxide gel.

8. A composite support according to claim 7 wherein the vanadium oxide gel comprises silver doped vanadium pentoxide.

9. A composite support according to claim 2, wherein the auxiliary layer comprises a polymeric binder.

10. A composite support according to claim 5, wherein the auxiliary layer binder comprises cellulose or a cellulose derivative, a polyurethane, an acrylic or acrylamide polymer, a polycarbonate, a polyester, a polystyrene, or gelatin.

11. A composite support according to claim 10, wherein the auxiliary layer binder comprises cellulose nitrate, cellulose diacetate, cellulose triacetate, or cellulose acetate butyrate.

12. A composite support according to claim 2, wherein the electrically conductive layer polymeric binder comprises an aqueous dispersible polyesterionomer, sulfopolymer, polyvinyl chloride resin, vinylidene chloride based latex, polyurethane, or cellulose derivative.

13. A composite support according to claim 1 in which the auxiliary layer is a transparent magnetic recording layer.

14. A composite support according to claim 13 wherein the transparent magnetic recording layer comprises $Fe_2O_3$ or $Fe_3O_4$ magnetic particles dispersed in a polymeric binder.

15. A composite support according to claim 1, wherein the adhesion promoting layer is coated between the polymeric film and the electrically conductive layer, and the adhesion promoting layer is in contiguous contact with the activated surface of the polymeric film.

16. A composite support according to claim 1, wherein the adhesion promoting layer is coated between the electrically conductive layer and the auxiliary layer, and the electrically conductive layer is in contiguous contact with the activated surface of the polymeric film.

17. A composite support according to claim 1 wherein the polymeric film is a polyester film.

18. A composite support according to claim 17 wherein the polymeric film comprises polyethylene terephthalate or polyethylene naphthalate.

19. A composite support according to claim 1 wherein the polymeric film has been surface-treated by corona-discharge treatment, glow-discharge treatment, or exposure to ultraviolet radiation.

20. A composite support according to claim 19 wherein the polymeric film has been surface treated by glow-discharge treatment in an atmosphere comprised of oxygen, nitrogen, helium, argon, carbon dioxide, ammonia, or water vapor.

21. An imaging element for use in an image-forming process, comprising a support, an image-forming layer, an electrically conductive layer, and an auxiliary layer over the electrically conductive layer, wherein the support comprises a surface which has been activated by energetic treatment, the electrically conductive layer comprises an electrically conductive agent dispersed in a polymeric binder, and wherein the element further comprises an adhesion promoting layer comprising an aqueous dispersible, aliphatic, anionic polyurethane binder having an ultimate elongation to break of at least 350 percent either between the support and the electrically conductive layer or between the electrically conductive layer and the auxiliary layer, and the electrically conductive layer or adhesion promoting layer is in contiguous contact with the activated surface of the support.

22. An imaging element according to claim 21 in which the electrically conductive layer and the image forming layer are on the same side of the support.

23. An imaging element according to claim 21 in which the electrically conductive layer and image forming layer are on opposite sides of the support.

24. An imaging element according to claim 21 in which the image forming layer comprises silver halide grains dispersed in gelatin.

25. A photographic imaging element comprising a polyester film support, at least one photographic image recording layer comprised of silver halide grains dispersed in a gelatin binder on one side of the support, an electrically conductive layer on the side of the support opposite to the image recording layer, and a transparent magnetic recording layer overlying the electrically conductive layer, wherein the support comprises a surface which has been activated by energetic treatment, the electrically conductive layer comprises an electrically conductive agent dispersed in a polymeric binder, and wherein the element further comprises an adhesion promoting layer comprising an aqueous dispersible, aliphatic, anionic polyurethane binder having an ultimate elongation to break of at least 350 percent either between the support and the electrically conductive layer or between the electrically conductive layer and the transparent magnetic recording layer, and the electrically conductive layer or adhesion promoting layer is in contiguous contact with the activated surface of the support.

26. A photographic imaging element according to claim 25, wherein the electrically conductive agent comprises vanadium oxide gel.

27. A photographic imaging element according to claim 26, further comprising a permeability control layer for reduced water permeability coated between the electrically conductive layer and the transparent magnetic recording layer.

28. A photographic imaging element according to claim 25, wherein the adhesion promoting layer is coated between the support and the electrically conductive layer, and the adhesion promoting layer is in contiguous contact with the activated surface of the support.

29. A photographic imaging element according to claim 25, wherein the adhesion promoting layer is coated between the electrically conductive layer and the transparent magnetic recording layer, and the electrically conductive layer is in contiguous contact with the activated surface of the support.

* * * * *